US011603989B2

(12) United States Patent
Lehtonen et al.

(10) Patent No.: US 11,603,989 B2
(45) Date of Patent: Mar. 14, 2023

(54) CIRCULATING FLUIDIZED BED BOILER WITH A LOOPSEAL HEAT EXCHANGER

(71) Applicant: Valmet Technologies Oy, Espoo (FI)

(72) Inventors: Pekka Lehtonen, Tampere (FI); Tero Heino, Tampere (FI)

(73) Assignee: VALMET TECHNOLOGIES OY, Espoo (FI)

( * ) Notice: Subject to any disclaimer, the term of this patent is extended or adjusted under 35 U.S.C. 154(b) by 385 days.

(21) Appl. No.: 16/761,701

(22) PCT Filed: Dec. 12, 2018

(86) PCT No.: PCT/FI2018/050907
§ 371 (c)(1),
(2) Date: May 5, 2020

(87) PCT Pub. No.: WO2019/122509
PCT Pub. Date: Jun. 27, 2019

(65) Prior Publication Data

US 2021/0372610 A1 Dec. 2, 2021

(30) Foreign Application Priority Data

Dec. 19, 2017 (FI) ..... 20176134

(51) Int. Cl.
*F22B 31/00* (2006.01)
*F23C 10/06* (2006.01)
(Continued)

(52) U.S. Cl.
CPC ..... *F22B 31/0092* (2013.01); *F23C 10/06* (2013.01); *F23C 10/10* (2013.01);
(Continued)

(58) Field of Classification Search
CPC .... F23C 10/10; F23C 10/20; F23C 2206/101; F23C 10/28; F23C 2206/103; F23C 10/18;
(Continued)

(56) References Cited

U.S. PATENT DOCUMENTS 4,459,133 A * 7/1984 Moss ..... C01B 3/00 34/582
4,552,203 A * 11/1985 Chrysostome ..... B01J 8/26 165/300
(Continued)

FOREIGN PATENT DOCUMENTS

EP 0679837 A2 11/1995
EP 2107098 A2 10/2009
(Continued)

OTHER PUBLICATIONS

International Searching Authority, International Search Report and Written Opinion for International Application No. PCT/FI2018/050907, dated Mar. 20, 2019, (13 pages), European Patent Office, Rijswijk, Netherlands.
(Continued)

*Primary Examiner* — Kaity V Chandler
(74) *Attorney, Agent, or Firm* — Alston & Bird LLP

(57) ABSTRACT

A circulating fluidized bed boiler, comprising a furnace, a loopseal, and a loopseal heat exchanger arranged in the loopseal. The loopseal heat exchanger comprises at least an inlet chamber, a bypass chamber, and a first heat exchange chamber, heat exchanger pipes arranged in the first heat exchange chamber, and a primary particle outlet for letting out bed material from the first heat exchange chamber. The primary particle outlet has at least a first part and a second part separated from each other by a barrier element in such a way that the first part of the primary particle outlet has a first height and a first width, wherein a ratio of the first
(Continued)

height to the first width is less than 0.5 or more than 2. Use of the circulating fluidized bed boiler such that fluidizing gas and bed material are let out from the first heat exchange chamber via the primary particle outlet.

18 Claims, 7 Drawing Sheets

(51) Int. Cl.
*F23C 10/10* (2006.01)
*F23C 10/20* (2006.01)
*F23C 10/28* (2006.01)

(52) U.S. Cl.
CPC ..... *F23C 10/20* (2013.01); *F23C 10/28* (2013.01); *F23C 2206/102* (2013.01)

(58) Field of Classification Search
CPC .... F23C 10/005; F23C 10/26; F23C 2206/10; F23C 10/04; F23C 10/22; F23C 10/08; F23C 10/32; F23C 10/02; F23C 10/24; F23C 10/00; F23C 2900/99008; F23C 2206/102; F23C 10/06; F23C 10/01; F23C 10/16; F23C 10/30; F23C 10/14; F23C 10/002; F23C 99/00; F23C 10/12; F23C 6/045; F23C 6/04; F23C 2900/10008; F23C 9/003; F23C 2201/101; F22B 37/12; F22B 37/42; F22B 1/003; F22B 21/341; F22B 27/14; F22B 37/64; F22B 21/00; F22B 33/18; F22B 37/141; F22B 37/40; F22B 37/70; F22B 37/14; F22B 37/207; F22B 37/242; F22B 1/1815; F22B 37/101; F22B 37/20; F22B 21/34; F22B 37/227; F22B 37/001; F22B 37/06; F22B 37/202; F22B 37/208; F22B 37/025; F22B 37/365; F22B 37/22; F22B 1/00; F22B 35/18; F22B 37/00; B01J 8/0055; B01J 2208/00212; B01J 2208/00132; B01J 2208/00495; B01J 2208/00088; B01J 8/1818; B01J 8/1809; B01J 8/44; B01J 2208/00061; B01J 2208/00548; B01J 8/1827; B01J 8/24; B01J 2208/00371; B01J 8/005; B01J 8/1872; B01J 2208/00079; B01J 8/28; B01J 8/384; B01J 2208/00141; B01J 8/0065; B01J 8/32; B01J 2208/00902; B01J 2208/00513; B01J 8/386; B01J 2208/00539; B01J 8/18; B01J 2208/00752; B01J 8/34; B01J 8/1863; B01J 2208/0084; B01J 8/006; B01J 8/0025; B01J 2208/0053; B01J 2208/00761
See application file for complete search history.

(56) References Cited

U.S. PATENT DOCUMENTS 4,699,068 A * 10/1987 Engstrom ..... F22B 31/0084 406/173
4,813,381 A * 3/1989 Kullendorff ..... F23C 10/10 122/4 D
4,817,563 A * 4/1989 Beisswenger ..... F22B 31/0061 122/4 D
4,827,723 A * 5/1989 Engstrom ..... F01K 23/061 60/683
4,896,717 A * 1/1990 Campbell, Jr. ..... F28D 13/00 122/4 D
4,947,803 A * 8/1990 Zenz ..... F22B 31/0084 122/4 D
4,947,804 A * 8/1990 Abdulally ..... B01J 8/26 110/216
5,054,435 A * 10/1991 Wiehn ..... F23C 10/16 110/216
5,072,696 A * 12/1991 Abdulally ..... F22B 37/108 122/6 A
5,140,950 A * 8/1992 Abdulally ..... F23C 10/10 122/4 D
5,184,671 A 2/1993 Alliston et al.
5,239,946 A * 8/1993 Garcia-Mallol .... F22B 31/0084 122/4 D
5,345,896 A 9/1994 Hyppanen
5,463,968 A * 11/1995 Abdulally ..... F22B 31/0084 122/4 D
5,476,639 A * 12/1995 Hyppanen ..... F22B 31/0092 34/578
5,601,039 A * 2/1997 Hyppanen ..... F23C 10/10 55/444
5,682,828 A * 11/1997 Phalen ..... F23C 10/10 110/263
6,237,541 B1 * 5/2001 Alliston ..... F22B 31/0084 122/4 D
6,962,676 B1 * 11/2005 Hyppanen ..... F22B 31/0084 422/142
7,938,071 B2 * 5/2011 Jacobs ..... F23C 10/10 110/342
8,500,959 B2 * 8/2013 Lehto ..... F22B 31/0007 201/31
2001/0025702 A1 * 10/2001 Hyppanen ..... F22B 31/0076 165/96
2003/0202913 A1 * 10/2003 Maryamchik ..... B01J 8/388 55/459.1
2004/0065273 A1 * 4/2004 Baglione ..... F23C 10/10 122/4 D
2006/0000425 A1 * 1/2006 Kokko ..... F23C 10/10 122/4 D
2006/0011148 A1 * 1/2006 Baglione ..... F23J 15/027 122/4 D
2010/0294180 A1 * 11/2010 Chiu ..... F23C 10/10 431/11
2011/0265697 A1 * 11/2011 Sellakumar ..... F23C 10/10 110/297
2013/0105008 A1 * 5/2013 Jiang ..... F23C 10/005 137/511
2016/0377351 A1 * 12/2016 Park ..... F23C 10/00 165/119
2017/0051217 A1 * 2/2017 Chandran ..... C10J 3/48
2017/0066983 A1 * 3/2017 Jack ..... C01B 3/26
2017/0120211 A1 * 5/2017 Adham ..... C10B 53/02
2017/0284660 A1 * 10/2017 Chiu ..... F23C 10/22
2019/0249866 A1 * 8/2019 Lehtonen ..... F23J 1/00

FOREIGN PATENT DOCUMENTS

WO WO-1994/011284 A1 5/1994
WO WO-1994/011671 A1 5/1994
WO WO-2004/091768 A1 10/2004
WO WO-2010/052372 A1 5/2010
WO WO-2019/122509 A1 6/2019

OTHER PUBLICATIONS

Finnish Office Action for Finnish Patent Application No. 20176134, dated Jun. 14, 2018, (6 pages), Finnish Patent and Registration Office, Helsinki, Finland.

* cited by examiner

CIRCULATING FLUIDIZED BED BOILER WITH A LOOPSEAL HEAT EXCHANGER

CROSS REFERENCE TO RELATED APPLICATIONS

This application is a National Stage Application, filed under 35 U.S.C. 371, of International Application No. PCT/FI2018/050907, filed Dec. 12, 2018, which claims priority to Finland Application No. 20176134, filed Dec. 19, 2017; the contents of both of which are hereby incorporated by reference in their entirety.

BACKGROUND

Related Field

The invention relates to circulating fluidized bed boilers. The invention relates to loopseal heat exchangers. The invention relates to particle coolers.

Description of Related Art

A fluidized bed heat exchanger is known from U.S. Pat. No. 5,184,671. Such a fluidized bed heat exchanger is designed to recover heat from hot particulate material of a fluidized bed. In the past, it has been realized that a fluidized bed heat exchanger can be used in a loopseal of a circulating fluidized bed boiler. When the fluidized bed heat exchanger is arranged in connection with a steam generator to recover heat from the bed material of the fluidized bed, typically steam becomes superheated, whereby such a fluidized bed heat exchanger may be referred to as a fluidized bed superheater. Such a heat exchanger may be referred to as a loopseal heat exchanger or a loopseal superheater.

One problem in loopseal heat exchangers is that the fluidizing air of the furnace is designed to flow in a certain direction: from a furnace 50 to a cyclone 40 via the flue gas channel 20, and therefrom to superheaters 26, as indicated in FIG. 1. From the cyclone, the separated bed material continues to a loopseal 5. However, a loopseal heat exchanger comprises an inlet and an outlet for particulate material, and the fluidizing air may, in certain cases, tend to flow in a reverse direction, i.e. from the furnace 50 to the cyclone 40 via the loopseal 5. To prevent this from happening, a loopseal heat exchanger may be provided with an additional chamber forming an extra loop seal. However, additional chambers make the structure of the heat exchanger more complex, whereby the heat exchanger is harder to manufacture and thus more expensive.

Moreover, the bed material of a fluidized bed boiler comprises inert particulate material and ash. In known solutions, all the bed material (i.e. also the ash) is conveyed from the loopseal heat exchanger to the furnace of the fluidized bed boiler, from which the ash can be collected as bottom ash. However, some of the ash may form agglomerates that hinder the operation of the fluidized bed reactor. The ash or the agglomerates may, for example, limit the air flow from a grate of a furnace, which results in uneven air flow in the furnace. In addition to affecting the operation of furnace, because of the ash, the channels need to be designed sufficiently large to convey also the ash. This may limit the capacity of the boiler.

BRIEF SUMMARY

It has been noticed that by dividing a particle outlet to a first part and a second part with a barrier element, the problem of the air flowing in wrong direction can be avoided. Correspondingly, the parts of the particle outlet have a reasonably high aspect ratio, as detailed in the claims and the description. Moreover, it has been found that when the loopseal heat exchanger is free from a separate gas lock chamber, the loopseal heat exchanger may be equipped with first ash removal channel for letting out ash from the loopseal heat exchanger. Such a construction increases capacity and is easy to manufacture. Easily manufacturable loopseal heat exchanger also reduces costs of the boiler.

To illustrate different views of the embodiments, three orthogonal directions Sx, Sy, and Sz are indicated in the figures. In use, the direction Sz is substantially vertical and upwards. In this way, the direction Sz is substantially reverse to gravity.

DETAILED DESCRIPTION OF VARIOUS EMBODIMENTS

Figure 1:
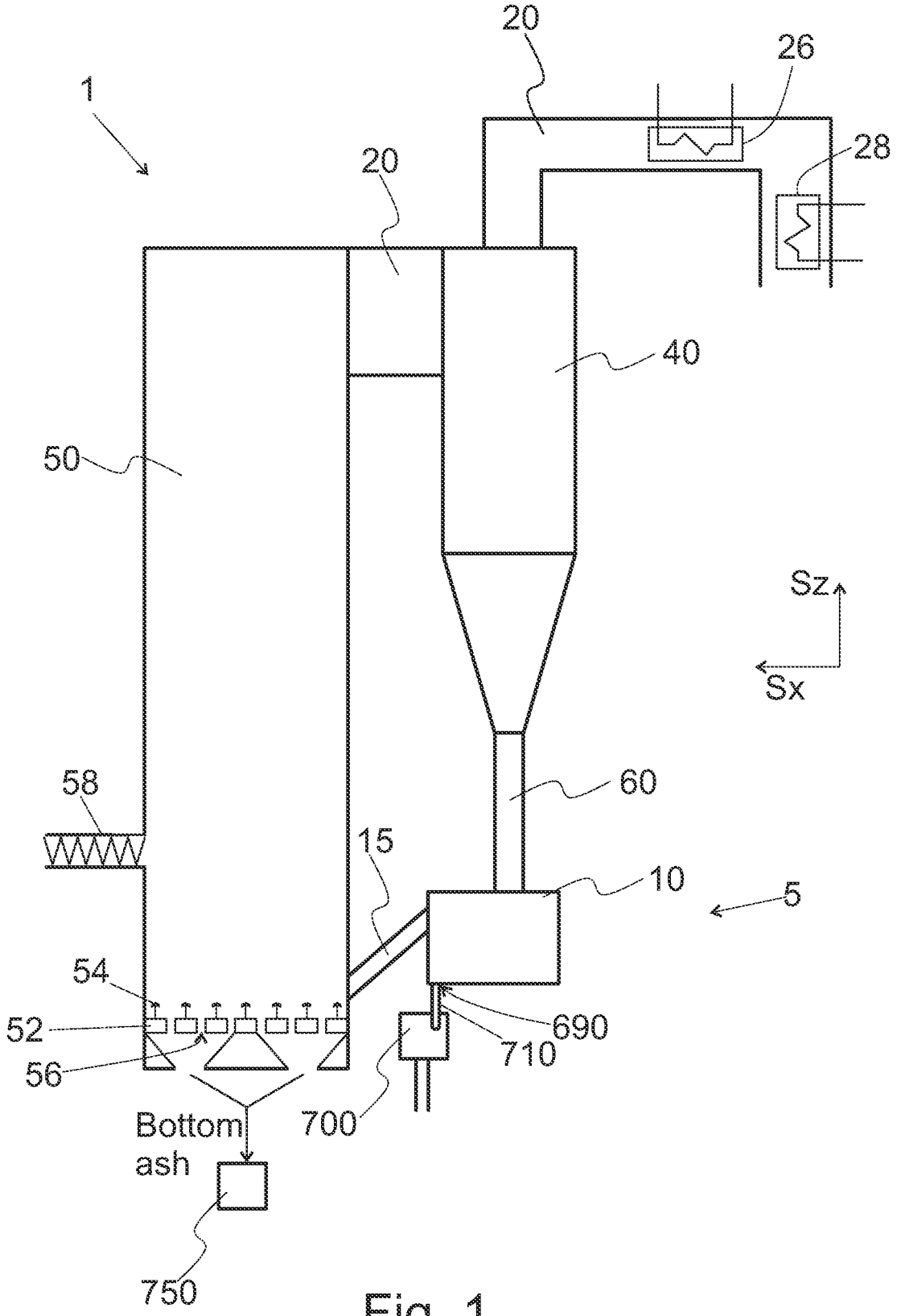
FIG. 1 shows a circulating fluidized bed boiler in a side view.

FIG. 1 shows a circulating fluidized bed boiler 1 in a side view. The circulating fluidized bed boiler 1 comprises a furnace 50, a cyclone 40, and a loopseal 5. In FIG. 1, flue gas channels are indicated by the reference number 20. Typically, the boiler 1 comprises heat exchangers 26, 28 within a flue gas channel 20, the heat exchangers 26, 28 being configured to recover heat from flue gases. Some of the heat exchangers may be superheaters 26 configured to superheat steam. Some of the heat exchangers may be economizers 28 configured to heat and/or boil water.

Within the furnace 50, some burnable material is configured to be burned. The burnable material may be fed to the furnace 50 through a primary fuel inlet 58. A conveyor, e.g. a screw conveyor, may be arranged to feed the burnable material. Some inert particulate material, e.g. sand, is also arranged in the furnace 50. The mixture of the particulate material and the burnable material and/or ash is referred to as bed material. At the bottom of the furnace 50, a grate 52 is arranged. The grate 52 is configured to supply air into the furnace in order to fluidize the bed material and to burn at least some of the burnable material to form heat, flue gas, and ash. In a circulating fluidized bed, the air supply is so strong, that the bed material is configured to flow upwards in the furnace 50. The grate 52 comprises grate nozzles 54 for supplying the air. The grate 52 limits bottom ash channels 56 for removing ash from the furnace 50.

From the upper part of the furnace 50, the fluidizing gas and the bed material are conveyed to a cyclone 40 in order to separate the bed material from gases. From the cyclone 40, the bed material falls through a channel 60 to a loopseal 5. Preferably, the loopseal 5 does not have a common wall with the furnace 50. This gives more flexibility to the structural design of the boiler 1, in particular, when an inlet 650 for secondary fuel is arranged in the loopseal 5, as will be detailed below. At least when the loopseal 5 does not have a common wall with the furnace 50, the bed material is returned from the loopseal 5 to the furnace 50 via a return channel 15. The return channel 15 is configured to convey bed material from the loopseal 5 to the furnace 50.

Referring to FIG. 1, a loopseal heat exchanger 10 is arranged in the loopseal 5. Referring to FIGS. 2 to 7, the loopseal heat exchanger 10 comprises walls 510, 520, 530, 540, 550 or wall parts. Herein the term wall part refers to a part of a wall. For example the wall parts 530, 540, 550 may be considered as different walls; however, when they are parallel and belong to a same plane, they may be considered to form only a single wall. Typically the walls or wall parts are formed of heat transfer tubes, which are configured to recover heat from the bed material. In an embodiment, the wall parts are formed of heat transfer tubes, which are configured to recover heat from the bed material to liquid heat transfer medium, such as water.

Figure 2:
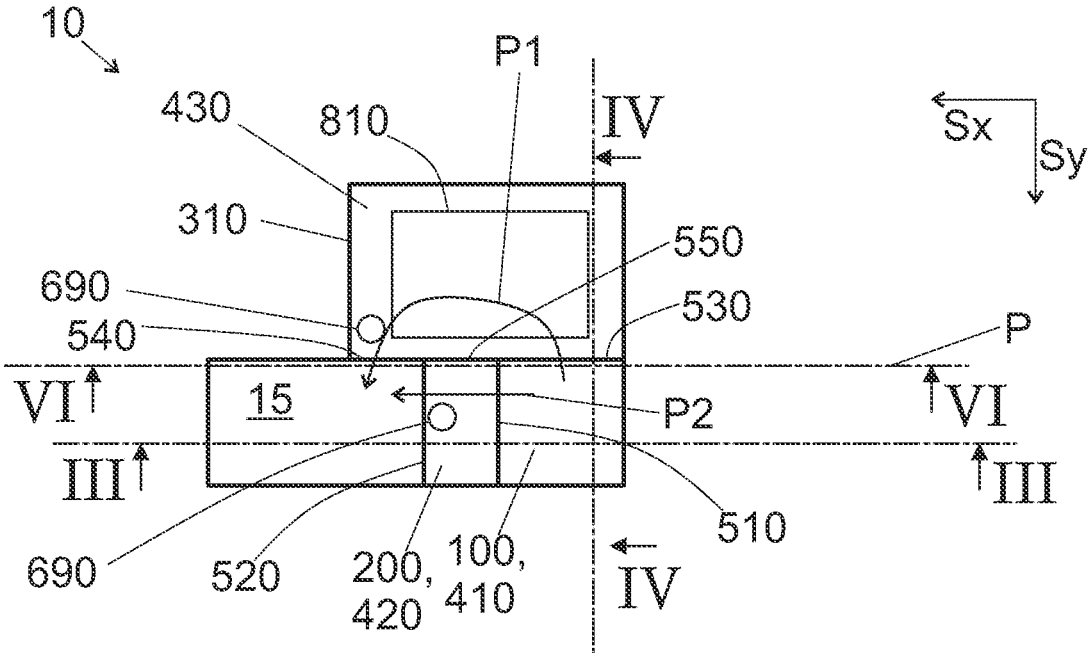
FIG. 2 shows different chambers of a loopseal heat exchanger according to a first embodiment in a top view.
Figure 5A:
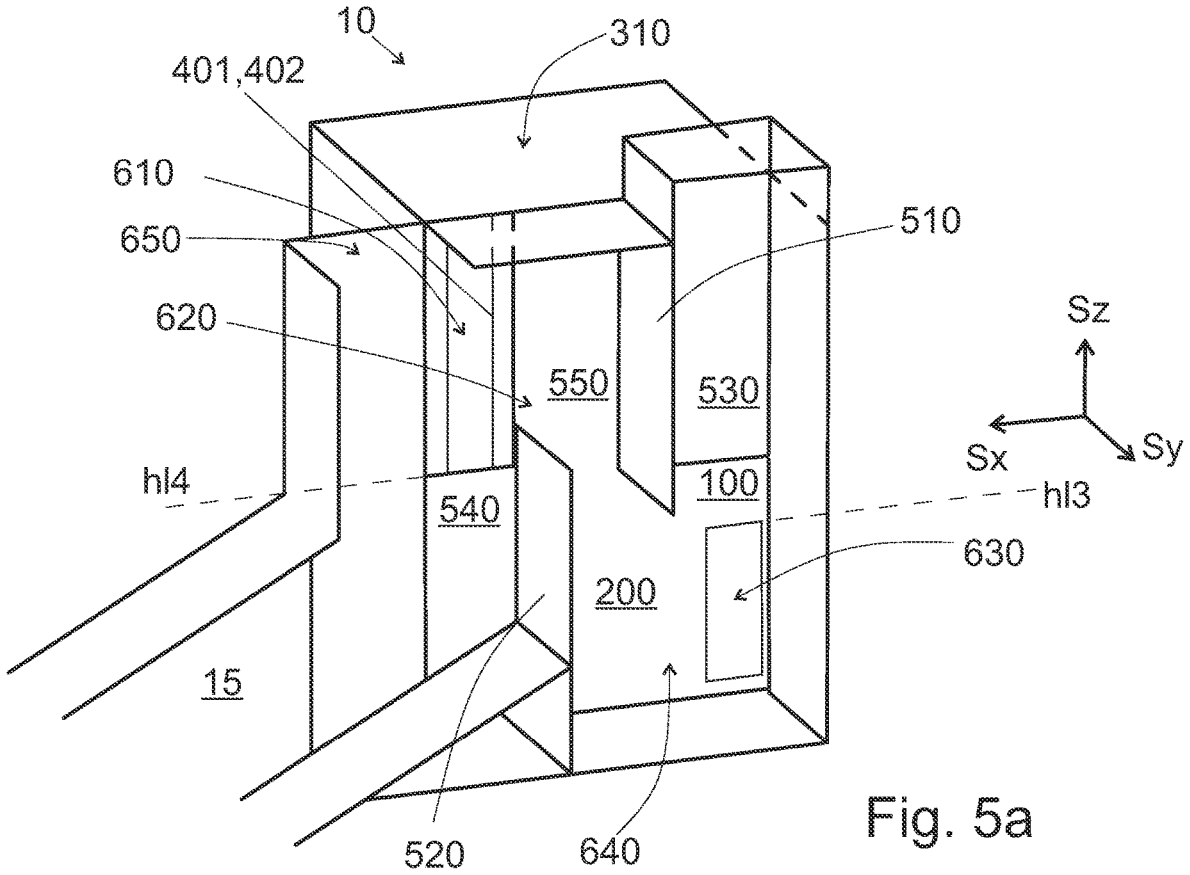
FIG. 5*a* shows, in a perspective view, inner parts of the loopseal heat exchanger of FIG. 2.

Referring to FIG. 2, the walls of the loopseal heat exchanger 10 limit (i.e. the loopseal heat exchanger 10 has) at least an inlet chamber 100, a bypass chamber 200, and a first heat exchange chamber 310. The purpose of the first heat exchange chamber 310 is to recover heat. Therefore, heat exchanger pipes 810 arranged in the first heat exchange chamber 310. These heat exchanger pipes 810 are configured to superheat steam. The walls further limit primary particle outlet 610 for letting out bed material from the first exchange chamber 310. The primary particle outlet 610 is limited from below by a wall part 540 (see FIGS. 3 and 5*a*) which may further limit the first exchange chamber 310. As indicated in FIG. 5*a*, in an embodiment, the wall part 540 also limits the return channel 15. The wall part 540 will be referred to as a fourth wall part, when considered necessary.

FIG. 2 indicates two different flow paths, P1 and P2, for the bed material. The first flow path P1 runs through the first heat exchange chamber 310. Thus, when the bed material runs through the first path P1, heat of the bed material is recovered by the heat exchanger pipes 810. The second flow path P2 runs through the bypass chamber 200. Heat exchanger pipes are not arranged inside the bypass chamber 200. Thus, when the bed material runs through the second path P2, heat of the bed material is not recovered by heat exchanger pipes within the chamber 200. However, it is noted that the walls of the chambers 100, 200, 310 may be formed of heat transfer tubes. As will be detailed below, some of the bed material may flow through the first path P1 at the same time another part of the bed material flows through the second path P2. In the alternative, the bed material may be guided through only one of the paths P1 or P2, depending on the needs.

In addition to bed material, some light ash may be conveyed to the channel 15 through the primary particle outlet 610. Also some heavy ash may be conveyed along the bed material. In an embodiment, the loopseal heat exchanger 10 comprises an ash removal channel 690. In such an embodiment, most of heavy ash becomes separated and expelled through the ash removal channel 690 because of a sieving effect of the loopseal heat exchanger 10. Moreover, because of the sieving effect, the material removed via the ash removal channel 690 comprises mainly ash. For example, the material removed via the ash removal channel 690 comprises ash to a greater extent than the material removed via the primary particle outlet 610.

FIG. 2 indicates two locations for an ash removal channel 690. In an embodiment, the loopseal heat exchanger 10 comprises only one ash removal channel 690; e.g. either in the first heat exchange chamber 310 or in the bypass chamber 200. However, in an embodiment, the loopseal heat exchanger 10 comprises two ash removal channels 690. For example, the loopseal heat exchanger 10 may comprise an ash removal channel 690 in the first heat exchange chamber 310 and another ash removal channel 690 in the bypass chamber 200. Moreover, in an embodiment, the loopseal heat exchanger 10 comprises three ash removal channels 690, e.g. in the chambers indicated in FIG. 8. As indicated above, when the loopseal heat exchanger 10 comprises the ash removal channel 690, the capacity of the boiler is increased, since ash needs not to be conveyed to the furnace 50. Correspondingly, for the same boiler capacity, a smaller loopseal heat exchanger 10 may suffice. In this way, also the ash removal channel(s) 690 decreases the manufacturing costs for the loopseal heat exchanger 10.

When the ash is removed from the loopseal heat exchanger 10, as indicated above, the ash is preferably not conveyed into the furnace 50 of the fluidized bed boiler 1. Since the ash is hot, it contains recoverable heat. Thus, in a preferred embodiment, the circulating fluidized bed boiler 1 comprises an ash cooler 700 (see FIG. 1). The ash cooler 700 is configured to receive ash from the ash removal channel 690 or channels 690. The ash cooler 700 may be configured to receive ash from the ash removal channel 690 through a pipeline 710 that is not connected to the furnace 50 of the fluidized bed boiler 1.

Moreover, preferably the ash cooler 700 is configured to receive bed material only from the loopseal 5 of the fluidized bed boiler 1. Preferably the ash cooler 700 is configured to receive bed material only from loopseal heat exchanger(s) 10 of the fluidized bed boiler 1. Preferably the ash cooler 700 is configured to receive bed material only from that loopseal heat exchanger 10 that comprises the ash removal channel 690. Moreover, the ash cooler 700 is configured to receive bed material from the loopseal heat exchanger 10 such that the ash is not conveyed via the furnace 50 from the loopseal heat exchanger 10 to the ash cooler 700. The ash cooler 700 may include a heat transfer medium circulation for recovering heat from the ash. The ash cooler 700 may comprise a screw conveyor. The ash cooler 700 may comprise a screw conveyor, wherein the screw conveyor is equipped with a circulation of cooling medium, such a water.

In an embodiment, the system comprises another ash cooler 750 configured receive bottom ash from the furnace 50 and to cool the bottom ash received from the furnace 50. The other ash cooler 750 may include a heat transfer medium circulation for recovering heat from the ash. The other ash cooler 750 may comprise a water-cooled screw conveyor, as indicated above.

When the bed material is fluidized in the first heat exchange chamber 310, the fluidizing gas may exit the first heat exchange chamber 310 through the primary particle outlet 610. The fluidizing gas may flow with the bed material through the return chute 15 to the furnace 50.

Figure 5B:
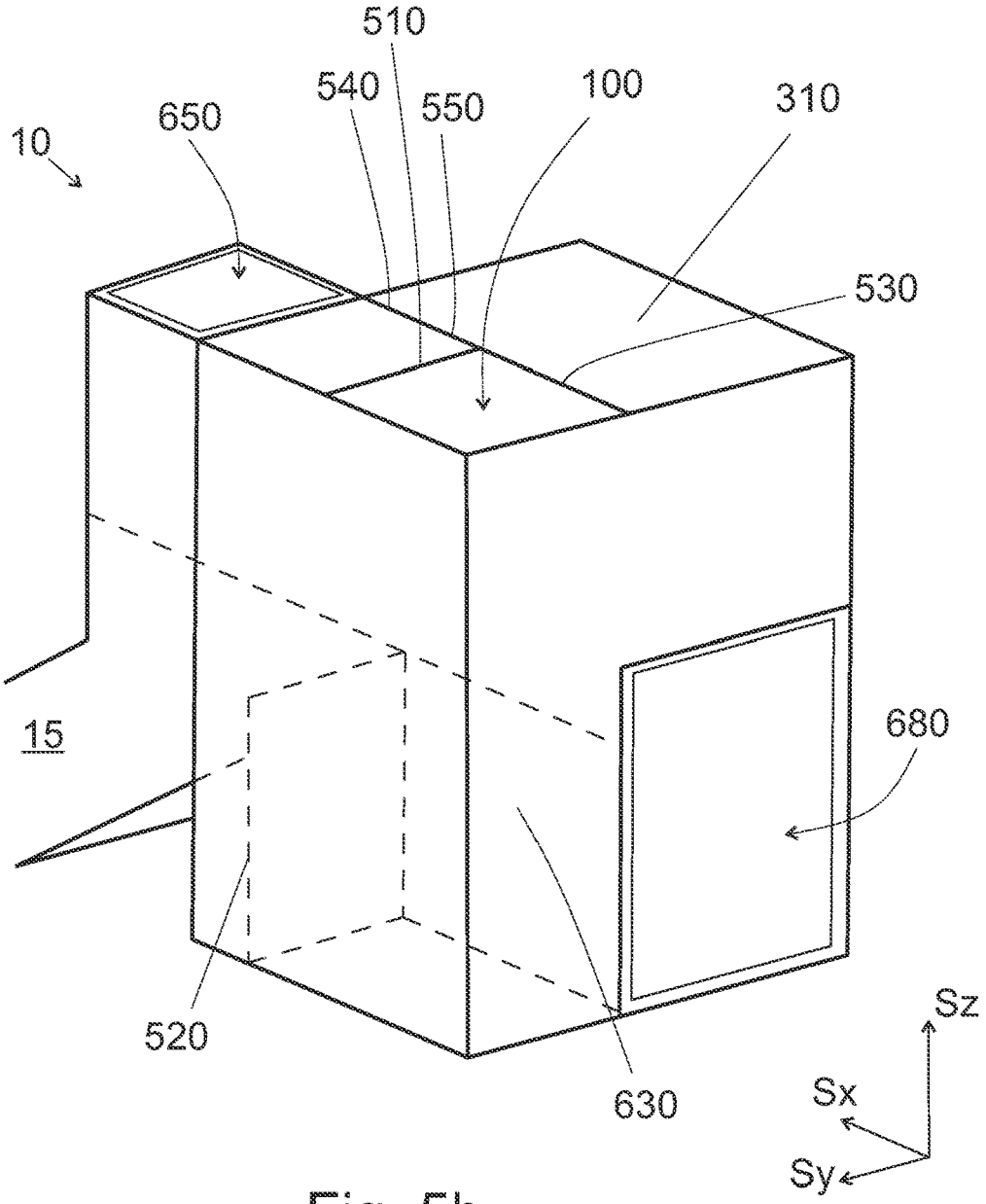
FIG. 5*b* shows, in a perspective view, the loopseal heat exchanger of FIG. 2 with an opening for receiving heat exchanger pipes.

Referring to FIGS. 5*a* and 5*b*, an embodiment of the loopseal heat exchanger 10 has an inlet 650 for secondary fuel. Typically, primary fuel is fed to the furnace 50 via a primary fuel inlet 58. However, when different types of fuels are used, secondary fuel may be fed to the furnace 50 via the inlet 650 of the loopseal heat exchanger 10. Then, the secondary fuel runs through the return chute 15 to the furnace 50 with bed material. Thus, even if two types of fuels are used, a wall of the furnace 50 needs not to be provided with an additional opening for such fuel. As is evident, in principle, the boiler would function without the primary fuel inlet 58, by using only the inlet 650 to feed the burnable material or materials (e.g. all different types of fuels). However, in practice, different types of fuels are preferably fed via different inlets for allowing better control of fuel feed.

As indicated in background, a problem in loopseal heat exchangers of prior art is the possibility of air flowing in a reverse direction, provided that an additional gas lock chamber is not used.

It has now been observed that the air flow can be controlled by proper measures of the primary particle outlet 610. In particular, it has been observed, that if the aspect ratio of the primary particle outlet 610 is close to one, air can flow in both directions through the primary particle outlet 610. Thus, the primary particle outlet 610 is designed in such a way that it comprises a part that has an aspect ratio that is not close to one.

Figure 7:
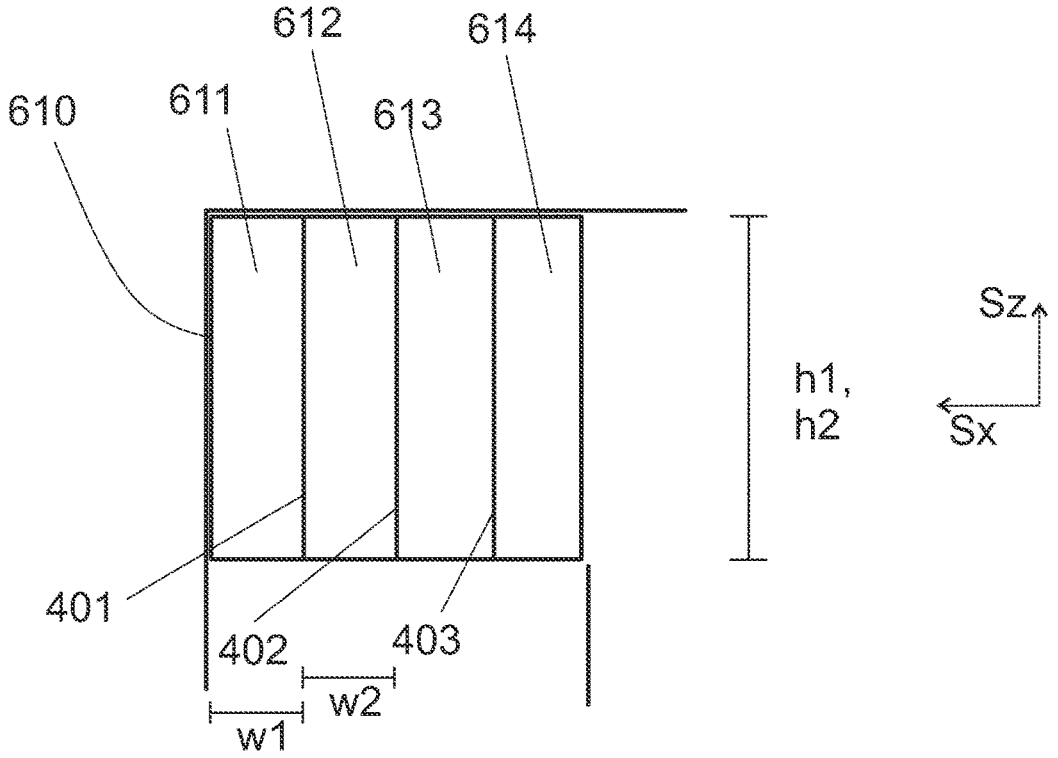
FIG. 7 shows in detail a primary particle outlet of a loopseal superheater.

With reference to FIG. 7, the loopseal heat exchanger comprises a barrier element 401 such that the primary particle outlet 610 has at least a first part 611 and a second part 612. The second part 612 is separated from the first part 611 by the barrier element 401. Such a division in general has the effect that the aspect ratios of the parts 611, 612 are not as close to one as the aspect ratio of the primary particle outlet 610. Referring to FIG. 7, the first part 611 of the primary particle outlet 610 has a first height h1 and a first width w1. The aspect ratio is not close to one, in the aforementioned meaning, when a ratio of the first height h1 to the first width w1 (i.e. the ratio h1/w1) is less than 0.5 or more than 2. In general, e.g. when the part 611 is not horizontal or vertical, the aspect ratio is defined as a ratio of the larger dimension to the smaller dimension, i.e. max(h1, w1)/min(h1, w1).

Figure 9A:
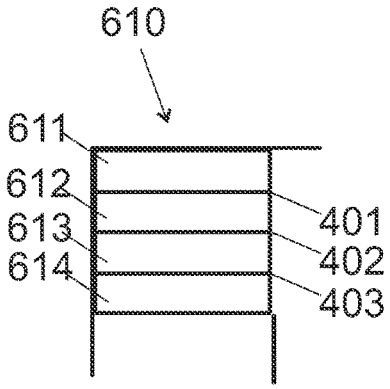
FIGS. 9*a* to 9*f* show in detail embodiments of a primary particle outlet of a loopseal superheater.
Figure 9B:
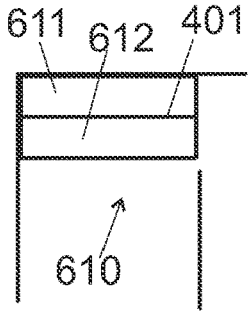
Figure 9C:
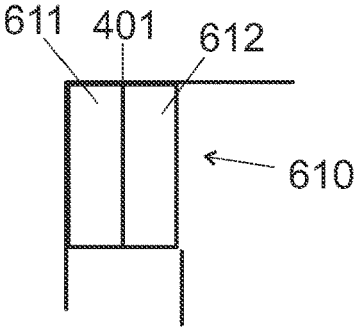
Figure 9D:
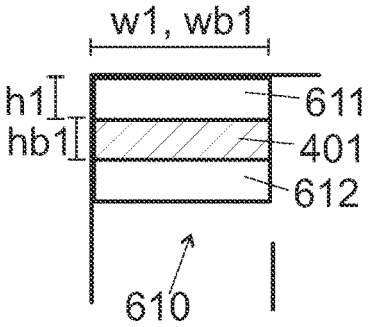
Figure 9E:
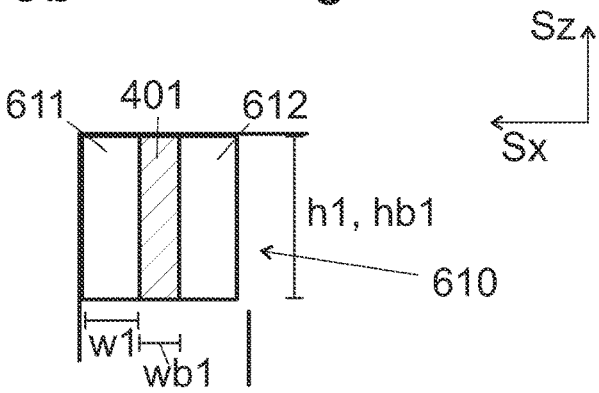
Figure 9F:
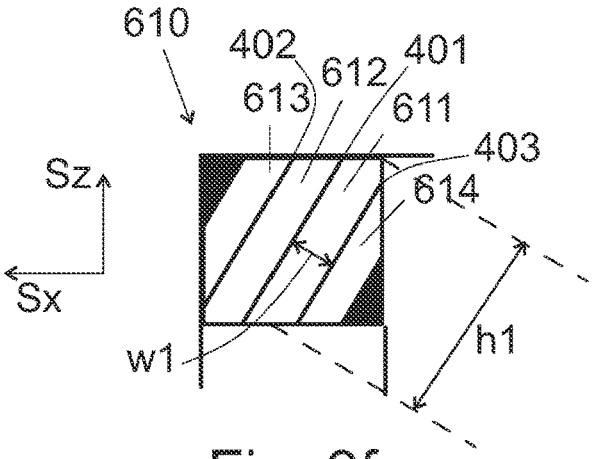

As for the terms first height and first width, these refer to the dimensions of a cross section of the first part 611, wherein the cross section is defined in a plane [A] that is parallel to the wall part 540 limiting both the first heat exchange chamber 310 and the primary particle outlet 610; or if such a wall part cannot be defined (e.g. if the primary particle outlet 610 is somewhat lengthy), [B] that has a normal that is parallel to a direction, which, in use, is an average direction of flow of gas in the primary particle outlet 610. As indicated in FIGS. 7 and 9*a* to 9*e*, in some embodiments, the height is vertical and the width is horizontal. However, the flow of air through the primary particle outlet 610 may be affected also in cases, where the aspect ratio of the first part 611 is not close to one, and the greater of the two dimensions of its aforementioned cross section is neither vertical nor horizontal. An example of such a primary particle outlet 610 is shown in FIG. 9*f*. As indicated therein, the term height may refer to a greater of the two dimensions on the cross sectional plane, in particular, if the part (611, 612, 613, 614) is not directed horizontally or vertically. Moreover, the width in such case refers to a dimension that is measured perpendicular to the height.

The loopseal heat exchanger may comprise only one barrier element. Referring to FIG. 7, preferably the loopseal heat exchanger comprises at least two (e.g. exactly two) barrier elements 401, 402 that are parallel to each other, and divide the primary particle outlet 610 to at least the first part 611, the second part 612, and a third part 613. More preferably, the loopseal heat exchanger comprises at least three (e.g. exactly three) barrier elements 401, 402, 403 that are parallel to each other, and divide the primary particle outlet 610 to at least the first part 611, the second part 612, the third part 613, and a fourth part 614. As is clear, the loopseal heat exchanger may comprise e.g. exactly four, at least four, exactly five, at least five, or a larger number of barrier elements.

In an embodiment, each one of the parts 611, 612 (and optionally 613, 614, if present), have an aspect ratio of more than 2. The aspect ratio for each part is defined as the ratio of the maximum of width and height to the minimum of width and height, i.e. in a manner similar to what has been detailed above for the first part. In particular, in an embodiment, a ratio (h2/w2) of a second height h2 to a second width w2 is less than 0.5 or more than 2, wherein the second height h2 is the height of the second part 612 and the second width w2 is the width of the second part 612.

Preferably the aspect ratio is even greater. In an embodiment, the aspect ratio of the first part 611 is more than three (i.e. the ratio h1/w1 is less than ⅓ or more than 3) or more than five (i.e. the ratio h1/w1 is less than ⅕ or more than 5). In an embodiment, each one of the parts 611, 612 (and optionally 613, 614, if present), have an aspect ratio of more than 3. In an embodiment, each one of the parts 611, 612 (and optionally 613, 614, if present), have an aspect ratio of more than 5.

In an embodiment, each one of the parts 611, 612 (and optionally 613, 614, if present), are configured to let out bed material from the first heat exchange chamber 310. The fluidized bed boiler 1 may be used in such a way that fluidizing gas and bed material are let out from the first heat exchange chamber 310 via the primary particle outlet 610. Correspondingly, fluidizing air from the furnace 50 is not let in into the first heat exchange chamber 310 via the primary particle outlet 610.

Preferably, the fluidized bed boiler 1 is used in such a way that fluidizing gas and bed material are let out from the first heat exchange chamber 310 via the primary particle outlet 610 such that a flow velocity of the fluidizing gas at the primary particle outlet 610 is at most 20 m/s and directed out of the first heat exchange chamber 310. The direction of the velocity has the effect that the boiler 1 functions as desired. The magnitude of the velocity has the effect that the flow is well controlled and does not excessively grind the surfaces of the loopseal heat exchanger 10. Preferably, a flow velocity of the fluidizing gas at the primary particle outlet 610 is from 5 m/s to 10 m/s and directed out of the first heat exchange chamber 310.

The barrier element 401 (and the other barrier elements 402, 403) may be made of any suitable material, such as metal or ceramic. In a preferable embodiment, the first barrier element 401 comprises a heat transfer tube or heat transfer tubes. For example, the first barrier element 401 may be a heat transfer tube covered by mortar, or the first barrier element 401 may consist of heat transfer tubes covered by mortar. As in case of the walls, the term heat transfer tube refers to a tube that is configured to recover heat to a liquid heat transfer medium. Thus, the first barrier element 401 in this embodiment is configured to recover heat to a circulation of a liquid heat transfer medium, such as water. Such pipes are shown in FIGS. 7 and 9*a* to 9*c*. However, as indicated in FIGS. 9*d* and 9*e*, a bar with certain, larger, barrier width wb1 may also serve as a barrier element. As indicated in FIGS. 5 and 7, in an embodiment, the first height h1 of the first part 611 is greater than the first width w1 of the first part 611. Moreover, in an embodiment, the second height h2 of the second part 612 is greater than the second width w2 of the second part 612. However, referring to FIGS. 9*a*, 9*b*, and 9*d*, the width may be greater than the height.

Moreover, preferably the area of the barrier elements 401, 402, 403, is small compared to the area of the parts 611, 612, 613, 614 of the outlet 610. This ensures a suitably small flow resistance, simultaneously preventing air from flowing in two directions. Referring to FIGS. 9*d* and 9*e*, the first barrier element has a first barrier height hb1 and a first barrier width wb1. The first barrier height hb1 is parallel to the first height h1. The first barrier width wb1 is parallel to the first width w1. In the embodiment of FIG. 9*d*, the first barrier width wb1 is substantially equal to the first width w1, and the first barrier height hb1 is substantially equal to the first height h1. However, as evidenced by FIGS. 9*a* and 9*b*, the first barrier height hb1 may be significantly less than the first height h1. In the embodiment of FIG. 9*e*, the first barrier width wb1 is substantially equal to the first width w1, and the first barrier height hb1 is substantially equal to the first height h1. In FIG. 9*c*, the first barrier width wb1 may be significantly less than the first width w1. However, the barrier width wb1 may be greater than the first width w1. In an embodiment, the product h1×w1 of the first height h1 and the first width w1 of the first part 611 of the primary particle outlet 610 is at least 33% of the product hb1×wb1 of the first barrier height hb1 and the first barrier width wb1 of the first barrier element 401. In an embodiment, the product h1×w1 of the first height h1 and the first width w1 of the first part 611 of the primary particle outlet 610 is at most four times the product hb1×wb1 of the first barrier height hb1 and the first barrier width wb1 of the first barrier element 401.

In addition to the relative dimensions, as discussed in terms of the aspect ratio and/or proportional area (i.e. product of width and height), also an absolute dimension of the part 611 or parts 611, 612, 613, 614 helps to prevent air from flowing in wrong direction. Thus, in an embodiment, the smaller of the first height h1 and the first width w1 is from 5 cm to 50 cm, such as from 5 cm to 40 cm. The smaller of the first height h1 and the first width w1 is generally denoted by min(h1,w1). Preferably this applies to each one of the parts 611, 612, 613, etc. of the primary particle outlet 610. Thus, in an embodiment, for each part of the primary particle outlet 610, the smaller of the height and the width of that part is from 5 cm to 50 cm, such as from 5 cm to 40 cm.

Preferably, the primary particle outlet 610 is sufficiently large to ensure reasonably small flow resistance. In an embodiment, a cross sectional area of the primary particle outlet 610 is at least 0.5 $m^2$, preferably at least 0.7 $m^2$. It is also noted that the cross sectional area of the primary particle outlet 610 is the sum of the cross sectional areas of its parts 611, and 612, optionally also 613, and 614 (and other parts, if present).

Figure 6:
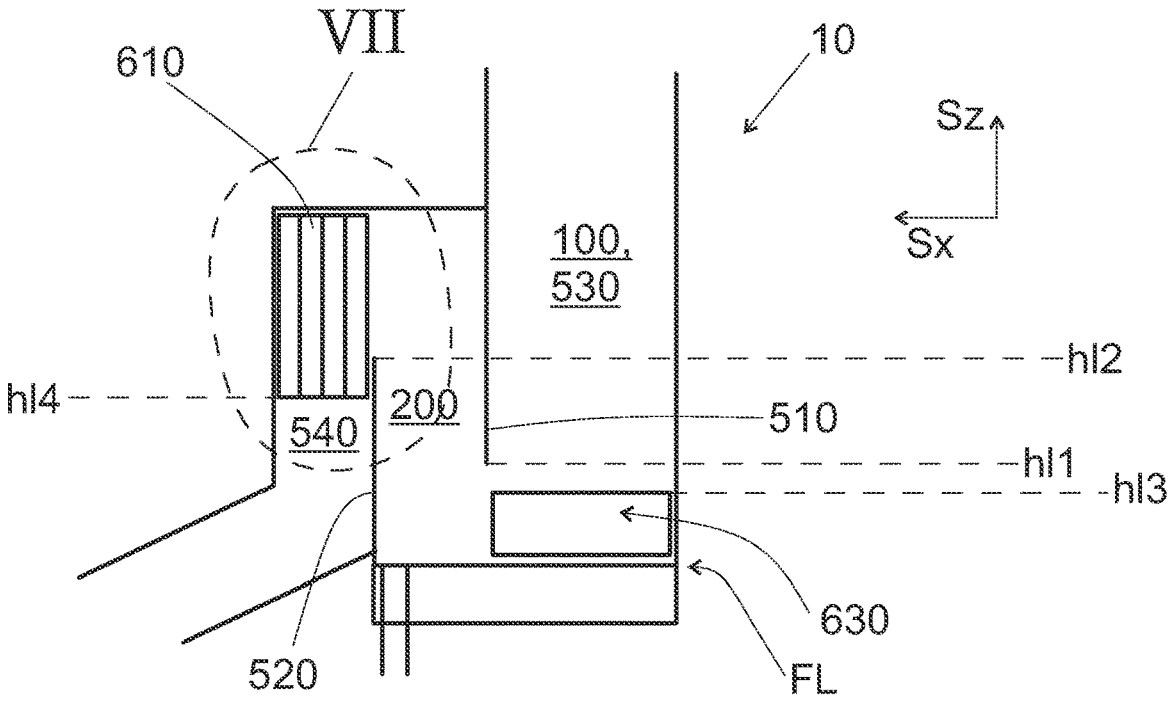
FIG. 6 shows the sectional view VI-VI of the loopseal heat exchanger of FIG. 2, the section VI-VI indicated in FIG. 2.

In order to remove ash, for reasons indicated in the background, the loopseal in an embodiment, heat exchanger 10 further comprises an ash removal channel 690 configured to convey ash out of the loopseal heat exchanger 10. This has the effect that ash will not be conveyed to the furnace 50. Preferably, the ash removal channel 690 is configured to convey ash from the bottom of the first heat exchange chamber 310 or from the bottom of the bypass chamber 200. This has the effect that ash will not accumulate within the loopseal heat exchanger 10, which improves the heat recovering capacity of the loopseal heat exchanger 10. In the alternative, the ash removal channel 690 may be arranged in a vertical wall of the loopseal heat exchanger. However, for purposes of emptying the loopseal heat exchanger for maintenance, a lower edge of the ash removal channel 690 is preferably located at most 50 cm above a floor of the loopseal heat exchanger 10. Floors 410, 420, 430 are indicated e.g. in FIG. 8. Moreover, a floor level FL is indicated in FIG. 6. In this way, the ash removal channel 690 or channels is/are arranged in a lower part of the chamber or chambers (100, 200, 310), i.e. on a wall of a chamber or chambers or at a bottom of a chamber or chambers.

The ash removal channel 690 is arranged at a lower vertical level than the primary particle outlet 610. The ash removal channel 690 may be arranged relative to the primary particle outlet 610 such that a top edge of the ash removal channel 690 is arranged at a lower vertical level than a lower edge of the primary particle outlet 610. The lower edge of the primary particle outlet 610 is denoted by hl4 in FIG. 6. In such an arrangement, the loopseal heat exchanger 10 functions as a sieve separating heavy ash from bed material. When the bed material in the loopseal heat exchanger 10 is fluidized, the loopseal heat exchanger 10 functions as an air sieve, which more effectively separates the heavy ash from the bed material. The heavy ash can then be collected from a lower part of e.g. the first heat exchange chamber 310 or from the bottom of the bypass chamber 200 via the ash removal channel 690.

In an embodiment, a top edge of the ash removal channel 690 is arranged at a lower level than a lower edge of the primary particle outlet 610. In an embodiment, a top edge of the primary ash removal channel 690 is arranged at least 50 cm or at least 1 m lower than a lower edge of the primary particle outlet 610. In an embodiment, a lower edge of the primary particle outlet 610 is arranged at least 1.5 m or at least 2 m above the floor of the loopseal heat exchanger. Correspondingly, in an embodiment, a lower edge of the primary particle outlet 610 is arranged at least 1 m or at least 1.5 m above an upper edge of the ash removal channel 690.

In an embodiment, an ash removal channel 690 is arranged at a lower part of the first heat exchange chamber 310. Alternatively or in addition, an ash removal channel 690 may be arranged at a lower part of the bypass chamber 200. Alternatively or in addition, an ash removal channel 690 may be arranged at a lower part of the inlet chamber 100. A more specific meaning of a lower part has been discussed above.

As indicated above, the walls of the loopseal heat exchanger 10 limit the first flow path P1. The first flow path P1 runs through a primary particle inlet 630 (cf. e.g. FIG. 6). In use, bed material is configured to enter the first heat exchange chamber 310 through the primary particle inlet 630. In addition, the first flow path P1 runs through the primary particle outlet 610. In an embodiment, the primary particle outlet 610 is arranged at an upper part of the first heat exchange chamber 310 and the primary particle inlet 630 is arranged at a lower part of the first heat exchange chamber 310. This has the effect that the construction of the loopseal heat exchanger remains simple. Not separate gas lock chamber is needed. In use, the particular material enters in a substantially downward direction the inlet chamber 100. Moreover, in use, the particular material flows through the first flow path P1 and exits the loopseal heat exchanger from the primary particle outlet 610. In an embodiment, the first flow path P1 runs below only one vertical wall part (i.e. a third wall part 530) of the loopseal heat exchanger 10 and runs above only one vertical wall part (i.e. a fourth wall part 540) of the loopseal heat exchanger 10. Moreover, in an embodiment, a highest point of the primary particle inlet 630 is arranged at a lower vertical level than a lowest point of the primary particle outlet 610.

As indicated above, the walls of the loopseal heat exchanger 10 limit the second flow path P2. The second flow path P2 runs through the bypass chamber 200. In use, the bed material enters in a substantially downward direction the inlet chamber 100. Moreover, in use, the bed material flows through the second flow path P2 and exits the loopseal heat exchanger from a secondary particle outlet 620 (see FIG. 3 or 5*a*). In an embodiment, the second flow path P2 runs below only one vertical wall part (i.e. a first wall part 510) of the loopseal heat exchanger 10 and runs above only one vertical wall part (i.e. a second wall part 520) of the loopseal heat exchanger 10. Referring to FIG. 5*a*, in an embodiment, the first wall part 510 is arranged in between the inlet chamber 100 and the bypass chamber 200. Moreover, the first wall part 510 is arranged in between the inlet chamber 100 and a part of the return chute 15. In an embodiment, the second wall part 520 is arranged in between the bypass chamber 200 and a part of the return chute 15. Moreover, the second wall part 520 is arranged in between the inlet chamber 100 and a part of the return chute 15.

In an embodiment, the walls of the loopseal heat exchanger 10 are arranged in such a way, that the first wall part 510 (see FIG. 3 or 5*a*) separates the inlet chamber 100 from the bypass chamber 200. A second wall part 520 is parallel to the first wall part 510. The second wall part 520 limits the bypass chamber 200. The second wall part 520 also limits the second particle outlet 620. The first wall part 510 extends downwards to a first height level hl1 and the second wall part 520 extends upwards to a second height level hl2, as indicated in FIG. 6. Moreover, the first height level hl1 is at a lower vertical level than the second height level hl2. This has the effect that flow of bed material through the bypass chamber 200 can be controlled. The flow of bed material through the bypass chamber 200 can be controlled e.g. with an amount of fluidizing air supplied by secondary nozzles 920, as detailed below. The difference between hl2 and hl1 will be discussed below.

As indicated above, a third wall part 530 limits the inlet chamber 100 and also limits the particle inlet 630 (see FIG. 5*a*). Bed material is configured to enter the first heat exchange chamber 310 through the particle inlet 630. Referring to FIG. 5*a*, the third wall part 530 extends downwards to a third height level h13.

Moreover, in order to ensure smooth flow of the particle material out from the first heat exchange chamber 310, in an embodiment, a part of the primary particle outlet 610 is arranged at a lower vertical level than the aforementioned second height level hl2 (i.e. the vertical level, at which the bed material leaving the bypass chamber 200 enters the return chute 15). Therefore, in an embodiment, a fourth wall part 540 limits the primary particle outlet 610 from below and limits also the return chute 15, and may further limit the first heat exchange chamber 310. Moreover, the fourth wall part 540 extends upwards to a fourth height level hl4. As indicated in FIG. 6, in an embodiment, the fourth height level hl4 is at a lower vertical level than the second height level hl2. This improves the bed material transfer through the heat exchange chamber 310, an correspondingly, provides for more flow resistance in bypass chamber 200. In an embodiment, the difference hl2−h14 may be e.g. from 50 mm to 300 mm, such as from 100 mm to 200 mm.

As indicated above, to control the flow of bed material within the first heat exchange chamber 310, in an embodiment, the fourth height level hl4 is at a higher vertical level than the third height level hl3. Typically the height levels h11 and hl3, i.e. the lower edges of the first wall part 510 arranged in between the inlet chamber 100 and the bypass chamber 200 and the wall part 530 limiting the particle inlet 630, are at a substantially same vertical level. The absolute value of the difference hl1−hl3, i.e. |hl1−hl3|, may be e.g. less than 100 mm, such as less than 75 mm, or less than 50 mm.

To control the flow of bed material through the first heat exchange chamber 310 the fourth height level hl4 is, in an embodiment, at a level that is more than 500 mm higher than the higher of the levels hl1 and hl3. Thus, in an embodiment, hl4−max(hl1, hl3)>500 mm. As is conventional, the function "max" gives the greater or greatest of its arguments. More preferably, the difference hl4−max(h11, hl3)>750 mm. What has been said above about the difference hl2−h14, also applies.

The structure of the loopseal heat exchanger, as shown in FIG. 2, is particularly simple, since the inlet chamber 100, the bypass chamber 200, and a part of the return channel 15 are all arranged on a same straight line. Such a structure is achieved by the walls and/or wall parts as indicated in the figures. Correspondingly, an embodiment of the loopseal heat exchanger 10 comprises a third wall part 530 that separates the inlet chamber 100 from the first heat exchange chamber 310, a fourth wall part 540 that limits the primary particle outlet 610 from below, and a fifth wall part 550 that separates the bypass chamber 200 from the first heat exchange chamber 310. As indicated in the Figures, in an embodiment, these wall parts (530, 540, 550) are parallel. In a preferable embodiment, the third wall part 530, the fourth wall part 540 and the fifth wall part 550 are parallel and belong to a plane P. Such a plane is indicated in FIG. 2. As indicated in FIG. 2, these wall parts (530, 540, 550) are vertical. Moreover, the third wall part 530 forms a part of a wall of both the inlet chamber 100 and the first heat exchange chamber 310. Moreover, the fourth wall part 540 forms a part of a wall of both the return channel 15 and the first heat exchange chamber 310. Moreover, the fifth wall part 550 forms a part of a wall of both the bypass chamber 200 and the first heat exchange chamber 310. Referring to FIG. 5*a*, in an embodiment, the third wall part 530 is arranged in between the inlet chamber 100 and the first heat exchange chamber 310. In an embodiment, the fourth wall part 540 is arranged in between a part of the return chute 15 and the first heat exchange chamber 310. In an embodiment, the fifth wall part 550 is arranged in between the bypass chamber 200 and the first heat exchange chamber 310.

Figure 4A:
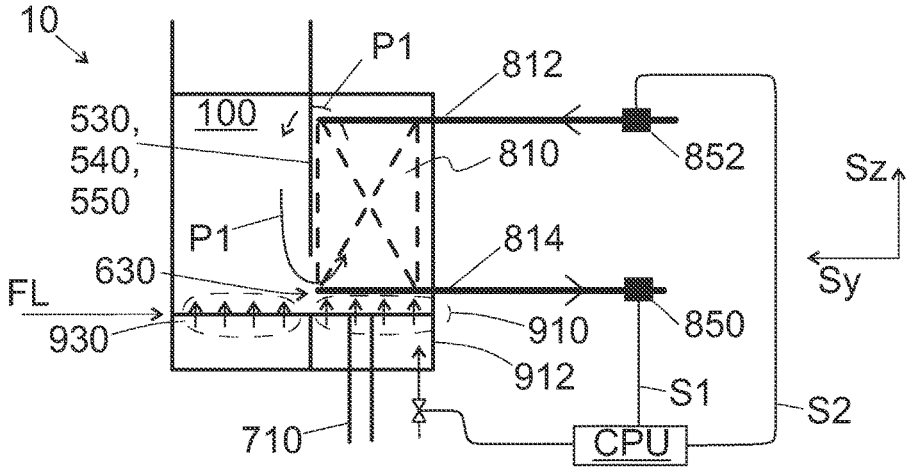
FIG. 4*a* shows the sectional view IV-IV of the loopseal heat exchanger of FIG. 2, the section IV-IV indicated in FIG. 2.

Referring to FIG. 4*a*, an embodiment of the loopseal heat exchanger comprises primary nozzles 910 configured to fluidize bed material within the first heat exchange chamber 310 by fluidizing gas. The primary nozzles 910 are arranged at the bottom of the first heat exchange chamber 310. The flow of the bed material through the first flow path P1 is enabled by fluidizing the bed material in the first heat exchange chamber 310. Moreover, the flow resistance through the first path P1 can be controlled by the degree of fluidization within the first heat exchange chamber 310. The loopseal heat exchanger 10 comprises an air channel 912 for distributing air to the primary nozzles 910. The aforementioned height levels hl4 and hl3 also contribute to the flow resistance through the first path P1. Preferably, the difference of these height levels is within the aforementioned limits also in the embodiment, wherein the loopseal heat exchanger comprises the primary nozzles 910.

The air distribution within the first heat exchange chamber 310 needs not to be uniform. Preferably, the distribution of the fluidizing air within the first heat exchange chamber 310 is designed in such a way that at least 90% at least 95% of the outer surfaces of the heat exchanger pipes 810 are in contact with flowing bed material. This is in contrast to cases, where the bed material would not flow, i.e. become stuck, on some surfaces of the exchanger pipes 810.

Figure 4B:
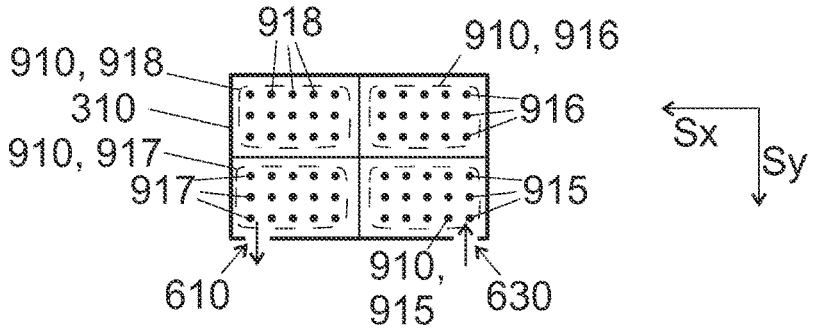
FIG. 4*b* shows in detail fluidizing nozzles of a first heat exchange chamber of the loopseal heat exchanger of FIG. 2.

Referring to FIG. 4*b*, in an embodiment, the primary nozzles 910 comprise first primary nozzles 915 and second primary nozzles 916. The first primary nozzles 915 are arranged closer to the primary particle inlet 630 than the second primary nozzles 916. Moreover, a flow resistance of the first primary nozzles 915 is larger than a flow resistance of the second primary nozzles 916. In effect, more fluidizing gas is guided through the second primary nozzles 916 than through the first primary nozzles 915. Correspondingly, the flow of bed material is enhanced in such locations that are further away from the primary particle inlet 630. In this way, the flowing bed material is more evenly distributed onto the surfaces of the heat exchanger pipes 810.

In an embodiment, the primary nozzles 910 comprise third primary nozzles 917 and fourth primary nozzles 918. The third primary nozzles 917 are arranged closer to the primary particle outlet 610 than the fourth primary nozzles 918. Moreover, a flow resistance of the third primary nozzles 917 is larger than a flow resistance of the fourth primary nozzles 918. In effect, more fluidizing gas is guided through the fourth primary nozzles 918 than through the third primary nozzles 917. Correspondingly, the flow of bed material is enhanced in such locations that are further away from the primary particle outlet 610. In this way, the flowing bed material is more evenly distributed onto the surfaces of the heat exchanger pipes 810.

In an embodiment, the third primary nozzles 917 are arranged closer to the primary particle outlet 610 than the first primary nozzles 915. In an embodiment, a flow resistance of the first primary nozzles 915 different from a flow resistance of the third primary nozzles 917. In an embodiment, a flow resistance of the first primary nozzles 915 is larger than a flow resistance of the third primary nozzles 917. In effect, more fluidizing gas is guided through the third primary nozzles 917 than through the first primary nozzles 915.

Figure 3:
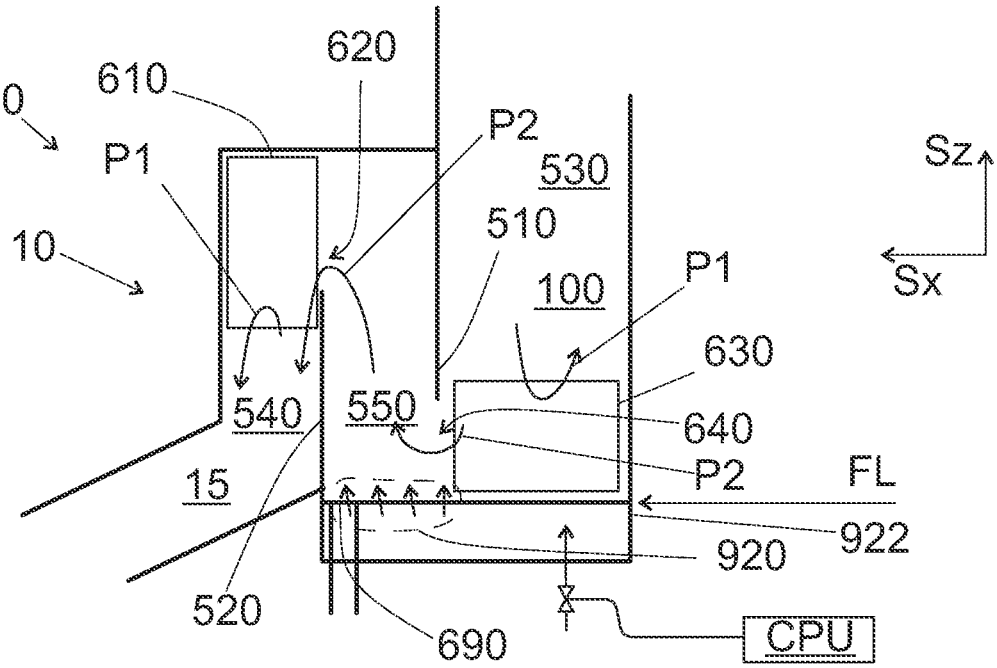
FIG. 3 shows the sectional view III-III of the loopseal heat exchanger of FIG. 2, the section III-III indicated in FIG. 2.

Referring to FIG. 3, an embodiment of the loopseal heat exchanger comprises secondary nozzles 920 configured to fluidize bed material within the bypass chamber 200 by fluidizing gas. The secondary nozzles 920 are arranged at the bottom of the bypass chamber 200. The flow of the bed material through the second flow path P2 is enabled by fluidizing the bed material in the bypass chamber 200. Moreover, the flow resistance through the second path P2 can be controlled by the degree of fluidization within the bypass chamber 200. The loopseal heat exchanger 10 comprises an air channel 922 for distributing air to the secondary nozzles 920. The aforementioned height levels hl2 and hl1 also contribute to the flow resistance through the second flow path P2. Preferably, the difference of these height levels is within the aforementioned limits also in the embodiment, wherein the loopseal heat exchanger comprises the secondary nozzles 920.

Depending e.g. on the load of the boiler and/or fuel supply into the boiler, there may be a greater or lesser need for heating heat transfer medium (e.g. superheating steam) by the fluidized bed heat exchanger 10. Thus, depending on the needs, a greater or lesser portion of the bed material may be conveyed through the first flow path P1, while the rest of the material is conveyed through the second flow path P2. Such a control can be achieved by the nozzles 910, 920. Moreover, the control is preferably automated.

Thus, an embodiment of a fluidized boiler 1 comprises a processor CPU (see FIGS. 3 and 4). The processor CPU is configured to control the flow of gas through the primary nozzles 910. In addition, the processor CPU is configured to control the flow of gas through the secondary nozzles 920. The processor CPU may be configured to control the flow of gas through the secondary nozzles 920 independently of the flow of gas through the primary nozzles 910. In this way, by controlling the flows of the gas through the primary and secondary nozzles, the relative amounts of bed material flowing through the first path P1 and the second path P2 can be controlled. The processor CPU may be configured to control e.g. the air flows to the air channels 912 and 922.

In an embodiment, the processor CPU is configured to control a ratio of the air flows through the primary nozzles 910 and the secondary nozzles 920. More specifically, when a primary air flow F1 is supplied through the primary nozzles 910 and a secondary air flow F2 is supplied through the secondary nozzles 920, the processor CPU is, in an embodiment, configured to control the ratio F1/F2.

The need for increasing or decreasing the amount of heating of the steam in the heating chamber 310 may depend on the temperature of the steam after the heat exchanger pipes 810 of the heating chamber 310. Therefore, with reference to FIG. 4, an embodiment comprises a first sensor 850 configured to sense a temperature of steam that has been conveyed through the heat exchanger pipes 810. Moreover, the first sensor 850 is configured to sense a temperature of the steam before the steam enters a turbine. Typically, the temperature of the steam conveyed to the turbine needs to be accurately controlled for proper functioning of the turbine. In an embodiment, the first sensor 850 is configured to give a first signal S1 indicative of a temperature of the steam and the processor CPU is configured to receive the first signal S1. Moreover, in an embodiment, the processor CPU is configured to control the ratio F1/F2 of the of the air flows through the primary nozzles 910 and the secondary nozzles 920 using the first signal S1.

For example, when the first signal S1 indicates that the temperature of the steam is decreasing or has decreased below a limiting value, more bed material may be guided to the heating chamber 310 to heat the steam within the heat exchanger pipes 810. Thus, the flow F1 through the primary nozzles 910 in the heating chamber 310 can be increased and/or the flow F2 through the secondary nozzles 920 in the bypass chamber 200 can be decreased.

Such an increase and/or decrease affects the aforementioned ratio F1/F2 of the flows. In particular, if more heating power is needed, the ratio F1/F2 may be increased.

In an embodiment, the boiler 1 further comprises a second sensor 852 configured to sense a temperature of steam that will enter the heat exchanger pipes 810. Thus, a temperature difference, by which the steam has been heated within the heating chamber 310, can be measured. Such a temperature difference can also be used by the processor CPU to control the ratio F1/F2. Thus, an embodiment comprises a second sensor 852 configured to sense a temperature of steam that enters the heat exchanger pipes 810. Moreover, in an embodiment the second sensor 852 is configured to sense a temperature of the steam after a superheater 26 arranged in flue gas channel 20 of the boiler 1. In an embodiment, the second sensor 852 is configured to give a second signal S2 indicative of a temperature of the steam, and the processor CPU is configured to receive the first signal S1 and the second signal S2. Moreover, in an embodiment, the processor CPU is configured to control the ratio F1/F2 of the of the air flows through the primary nozzles 910 and the secondary nozzles 920 using the first signal S1 and the second signal S2. For example, the processor CPU may be configured to compare the temperature difference, as determined based on the signals S1 and S2, to a pre-set temperature difference. Provided that this temperature difference is too small, more bed material is guided to the first heat exchange chamber 310 by increasing the ratio F1/F2 as indicated above. Correspondingly, provided that this temperature difference is too large, less bed material is guided to the first heat exchange chamber 310 by decreasing the ratio F1/F2 as indicated above.

In an embodiment, the primary nozzles 910 are configured to drive ash towards the ash removal channel 690 by a flow of the fluidizing gas. For example, as indicated in FIG. 2 an ash removal channel 690 may be arranged in the first heat exchange chamber 310, at the same end to which the primary particle outlet 610 has been arranged. The primary nozzles 910 may be configured to produce a fluidizing flow that is not exactly vertical, but tilted towards that end of the first heat exchange chamber 310 that comprises the ash removal channel 690. In addition or alternatively, the secondary nozzles 920 may be configured to drive ash towards an ash removal channel 690 of the bypass chamber 200 by a flow of the fluidizing gas. This is shown in FIG. 3, wherein at least some of the secondary nozzles 920 are tilted towards the ash removal channel 690.

Referring to FIG. 4*a*, an embodiment of the loopseal heat exchanger comprises tertiary nozzles 930 configured to fluidize bed material within the inlet chamber 100 by fluidizing gas. When the bed material also in the inlet chamber 100 is fluidized, the material flows easily in between the chambers (100, 200, 310). In particular, the ash may flow in between the chambers, which improves the ash removal through the ash removal channel 690.

Figure 8:
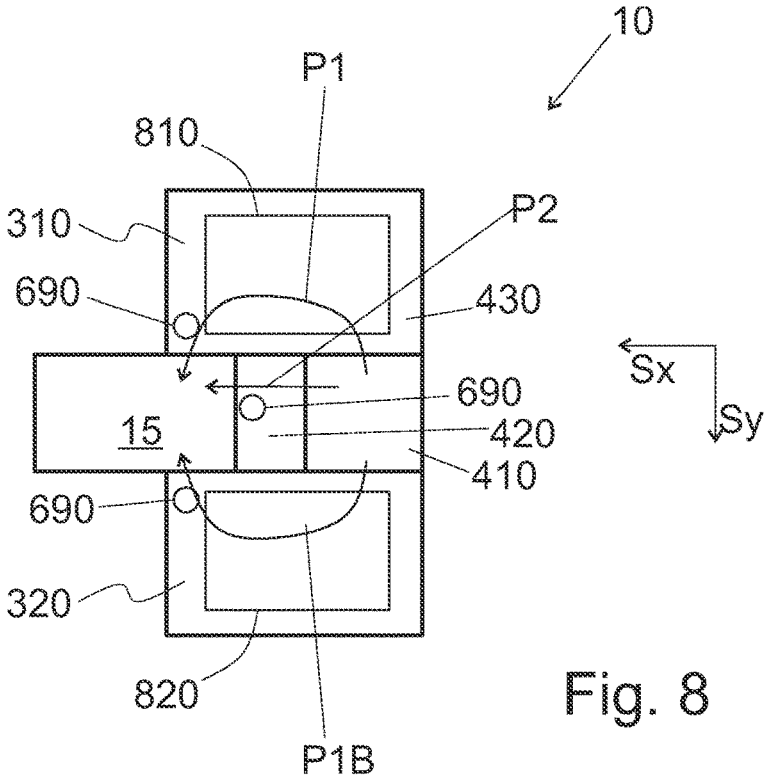
FIG. 8 shows different chambers of a loopseal heat exchanger according to a second embodiment in a top view.

Referring to FIGS. 2 and 8, in an embodiment, the inlet chamber 100 is limited from below by a first floor 410, the bypass chamber 200 is limited from below by a second floor 420, and the first heat exchange chamber 310 is limited by from below by a third floor 430. In an embodiment, the first floor 410 is arranged at a floor level FL. As indicated in FIGS. 3, and 4, the floor level FL refers to a vertical level of the first floor 410. In an embodiment, also the second floor 420 and the third floor 430 are arranged at the floor level FL. Thus all the floors 410, 420, and 430 are, in an embodiment, at the same vertical level. This has the technical effect that the inlet chamber 100, the bypass chamber 200, and the first heat exchange chamber 310 form a single compartment having only one floor. In such a structure, the ash may reasonably freely move from one chamber to another chamber. Thus, the removal of the ash becomes easy. Even only one ash removal channel 690 may suffice for purposes of removing ash. However, ash removal may be facilitated by adding another ash removal channel 690.

In an embodiment, the third wall part 530 limits the primary particle inlet 630, through which bed material is configured to enter the first heat exchange chamber 310 in use. Moreover, the primary particle inlet 630 extends in the downward vertical direction to the floor level FL. This, in connection with the floors 410 and 430 being at the same level, has the effect that ash is easily conveyed from the inlet chamber 100 to the first heat exchange chamber 310. Thus, an ash removal channel 690 may be arranged in the first heat exchange chamber 310.

In an embodiment, the first wall part 510 limits a secondary particle inlet 640, through which bed material is configured to enter the bypass chamber 200 in use. The secondary particle inlet 640 extends in the downward vertical direction to the floor level FL. This, in connection with the floors 410 and 420 being at the same level, has the effect that ash is easily conveyed from the inlet chamber 100 to the bypass chamber 200. Thus, an ash removal channel 690 may be arranged in the bypass chamber 200.

Preferably both the primary particle inlet 630 and the secondary particle inlet 640 extend in the downward vertical direction to the floor level FL, and all the three floors 410, 420, 430 are on the same level. In this case, only one ash removal channel 690 may suffice, since ash can move e.g. from the bypass chamber 200 to the first heat exchange chamber 310 or vice versa.

FIG. 8 shows another embodiment of a loopseal heat exchanger 10. The loopseal heat exchanger 10 of FIG. 8 comprises a second heat exchange chamber 320. Some bed material is configured to flow along a third flow path P1B through the second heat exchange chamber 320 to a tertiary particle outlet, and via the tertiary particle outlet to the return channel 15. Heat exchanger pipes 820 are arranged in the second heat exchange chamber 320 to recover heat therefrom. The inlet chamber 100 is arranged in between the first heat exchange chamber 310 and the second heat exchange chamber 320. This has the effect that the inlet chamber 100, as well as the return channel 15 are arranged in a horizontal direction Sy substantially at a center of the loopseal heat exchanger 10. Such a design may fit better to loopseals of some fluidized bed boilers.

However, such a structure is more complex than the structure of FIG. 2. Therefore, an embodiment comprises only one heat exchange chamber 310 that is equipped with heat exchanger pipes 810 configured to superheat steam. As indicated above, the walls of the loopseal heat exchanger 10 may comprise heat transfer tubes configured to heat liquid heat transfer medium.

Figure 10A:
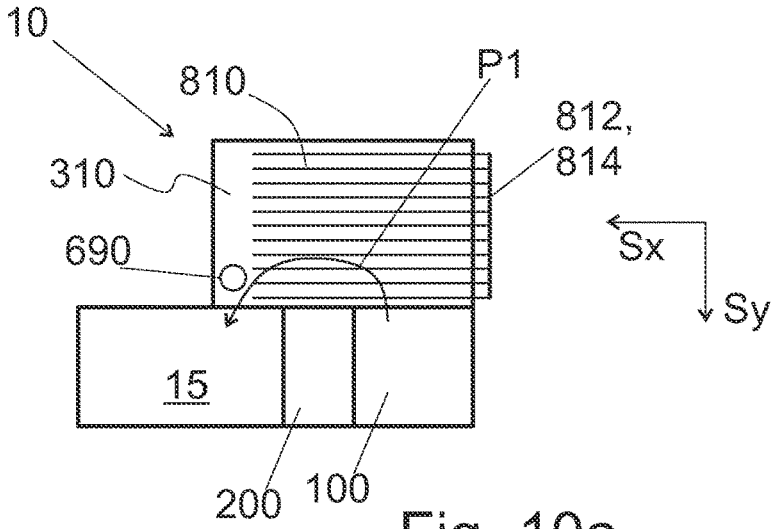
FIGS. 10*a* and 10*b* show arrangements of heat exchanger pipes in the loopseal heat exchanger of FIG. 2 in a top view.
Figure 10B:
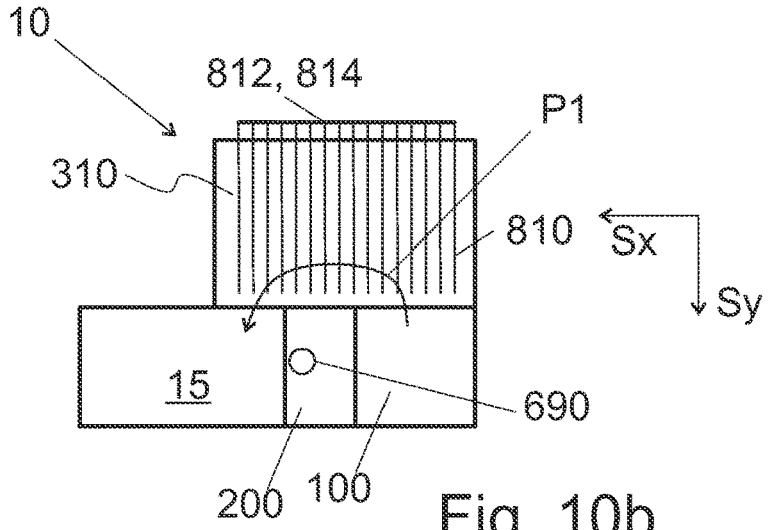

FIGS. 10*a* and 10*b* show embodiments of a loopseal heat exchanger 10. As indicated in the figures, the bed material in configured to flow through the first heat exchange chamber 310 through a first flow path P1. In the first heat exchange chamber 310, the first flow path P1 has a direction, which is inclined upwards, and substantially parallel to a direction from the inlet chamber 100 to the return channel 15. The heat exchanger pipes 810 typically have straight parts and curved parts. As indicated in FIG. 10*a*, in an embodiment, the straight parts form an angle of at most 30 degrees with a direction that is from the inlet chamber 100 to the channel 15. As indicated in FIG. 10*b*, in an embodiment, the straight parts form an angle of at least 60 degrees with a direction that is from the inlet chamber 100 to the channel 15.

The heat exchanger pipes 810 may constitute a heat exchanger module. Such a heat exchanger module may be insertable into and removable from the first heat exchange chamber 310. In an embodiment, a wall of the first heat exchange chamber 310 comprises an opening 680 (see FIG. 5*b*), and a part of a heat exchanger module is arranged in the opening. FIG. 5*b* shows walls of a loopseal heat exchanger, when such a heat exchanger module has not been inserted into the first heat exchange chamber 310. FIG. 10*a* shows a fluidized bed heat exchanger 10 of FIG. 5*b*, after a heat exchanger module has been inserted into the opening 680. As indicated in FIGS. 4*a* and 10*b*, such a module can, in the alternative, be inserted through an opening on another wall of the fluidized bed heat exchanger 10. Such a modular structure also makes the manufacture of the loopseal heat exchanger easier and in this way reduces the costs for manufacturing. The heat transfer pipes 810 may be manufactured separately, and later inserted into the chamber 310.

FIG. 4*a* shows an inlet tube 812 configured to distribute heat transfer medium (e.g. steam) into the heat exchanger pipes 810. An outlet tube 814 is configured to collect the heated heat transfer medium (e.g. steam) from the heat exchanger pipes 810. Such an inlet tube 812 and an outlet tube 814 are also shown in FIGS. 10*a* and 10*b*. The inlet tube 812 may be arranged above the outlet tube 814, as in FIG. 4*a*, or the inlet tube 812 may be arranged below the outlet tube 814 (not shown).

Figure 11:
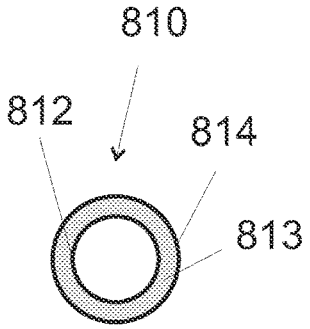
FIG. 11 shows a heat exchanger pipes having an inner pipe and a radially surrounding outer pipe.

A loopseal 5 is a harsh environment. Within the loopseal 5, the bed material grinds the heat exchanger pipes 810, and also corrosive gases may condense onto the pipes 810. Referring to FIG. 11, in order to protect the pipes 810, in an embodiment, the heat exchanger pipes 810 of the first heat exchange chamber 310 are provided with a protective shell. In such an embodiment, the heat exchanger pipes 810 comprise an inner pipe 812 radially surrounded by an outer pipe 814. The outer pipe 814 serves as a protective shell for the inner pipe 812. In addition, an insulating layer 813, such as an air gap and/or la layer of mortar, may be left in between the inner pipe 812 and the outer pipe 814. The inner diameter of the outer pipe 814 may be e.g. at least 1 mm more than the outer diameter of the inner pipe 812. The inner diameter of the outer pipe 814 may be e.g. from 1 mm 10 mm more than the outer diameter of the inner pipe 812. Thus, the thickness of the layer 813 of the thermally insulating material in between the inner pipe 812 and the outer pipe 814 may be e.g. from 0.5 mm to 5 mm, such as from 1 mm to 4 mm, such as from 1 mm to 2 mm.

The invention claimed is:

1. A circulating fluidized bed boiler, comprising:
- a furnace,
- a loopseal, and
- a loopseal heat exchanger arranged in the loopseal, the loopseal heat exchanger comprising:
  - at least an inlet chamber, a bypass chamber, and a first heat exchange chamber,
  - heat exchanger pipes arranged in the first heat exchange chamber, and
  - a primary particle outlet for letting out bed material from the first heat exchange chamber,
  - wherein the primary particle outlet has at least a first part and a second part separated from each other by a barrier element in such a way that:
  - the first part of the primary particle outlet has a first height and a first width, and
  - a ratio of the first height to the first width is less than 0.5 or more than 2.

2. The circulating fluidized bed boiler of the claim 1, further comprising an ash removal channel in at least one of the bypass chamber, the first heat exchange chamber, or the inlet chamber, wherein the ash removal channel or channels is/are preferably arranged in a lower part of the chamber or chambers.

3. The circulating fluidized bed boiler of claim 1, further comprising:
- barrier elements dividing the primary particle outlet to at least the first part, the second part, and a third part; and/or
- wherein each one of the parts has an aspect ratio of more than 2, preferably more than 3.

4. The circulating fluidized bed boiler of claim 1, wherein the smaller of the first height and the first width is from 5 cm to 50 cm.

5. The circulating fluidized bed boiler of claim 1, wherein the barrier element comprises a heat transfer tube or heat transfer tubes.

6. The circulating fluidized bed boiler of claim 1, wherein:
- a first wall part of the loopseal heat exchanger separates the inlet chamber from the bypass chamber,
- a second wall part of the loopseal heat exchanger is parallel to the first wall part and limits the bypass chamber and a second particle outlet,
- the first wall part extends downwards to a first height level,
- the second wall part extends upwards to a second height level, and
- the first height level is at a lower vertical level than the second height level.

7. The circulating fluidized bed boiler of claim 1, wherein:
- a third wall part of the a loopseal heat exchanger limits a primary particle inlet, through which bed material is configured to enter the first heat exchange chamber in use,
- the primary particle outlet is arranged at an upper part of the first heat exchange chamber, and
- the primary particle inlet is arranged at a lower part of the first heat exchange chamber.

8. The circulating fluidized bed boiler of claim 1, wherein:
- a third wall part separates the inlet chamber from the first heat exchange chamber,
- a fourth wall part limits the primary particle outlet from below,
- a fifth wall part separates the bypass chamber from the first heat exchange chamber,
- the third wall part, the fourth wall part, and the fifth wall part are parallel, and
- the third wall part, the fourth wall part, and the fifth wall part are preferably parallel and belong to a plane.

9. The circulating fluidized bed boiler of claim 1, wherein:
- heat exchanger pipes are arranged in the first heat exchange chamber; and
- the loopseal heat exchanger comprises primary nozzles arranged at the bottom of the first heat exchange chamber and configured to fluidize bed material within the first heat exchange chamber by fluidizing gas, such that a flow of bed material is enhanced in such locations that are further away from the primary particle outlet, and whereby flowing bed material is more evenly distributed onto surfaces of the heat exchanger pipes.

10. The circulating fluidized bed boiler of the claim 9, further comprising secondary nozzles configured to fluidize bed material within the bypass chamber by fluidizing gas.

11. The circulating fluidized bed boiler of the claim 10, comprising:
- a processor configured to:
  - control the flow of gas through the primary nozzles, and
  - control the flow of gas through the secondary nozzles such that the flow of gas through the secondary nozzles is controllable independently of the flow of gas through the primary nozzles, wherein preferably the processor is further configured to control a ratio of the air flows through the primary nozzles and the secondary nozzles.

12. The circulating fluidized bed boiler of the claim 11, further comprising:

a first sensor configured to sense a temperature of steam that has been conveyed through the heat exchanger pipes and to give a first signal indicative of a temperature of the steam, wherein the processor is configured to control the flow of gas through the primary nozzles and flow of gas through the secondary nozzles using the signal.

13. The circulating fluidized bed boiler of claim 1, further comprising:

primary nozzles configured to fluidize bed material within the first heat exchange chamber by fluidizing gas, and secondary nozzles configured to fluidize bed material within the bypass chamber by fluidizing gas.

14. The circulating fluidized bed boiler of claim 1, wherein:

a floor of the inlet chamber is arranged at a floor level, a floor of the bypass chamber is arranged at the floor level, and a floor of the first heat exchange chamber is arranged at the floor level.

15. The circulating fluidized bed boiler of claim 14, wherein:

at least one of:

a first wall part of the loopseal heat exchanger limits a secondary particle inlet, through which bed material is configured to enter the bypass chamber in use, and the secondary particle inlet extends in the downward vertical direction to the floor level;

or:

a third wall part of the loopseal heat exchanger limits a primary particle inlet, through which bed material is configured to enter the first heat exchange chamber in use, and the primary particle inlet extends in the downward vertical direction to the floor level.

16. The circulating fluidized bed boiler of claim 1, wherein:

a fourth wall part limits the primary particle outlet from below and the fourth wall part limits the first heat exchange chamber, a third wall part limits the inlet chamber and the third wall part limits a particle inlet, through which bed material is configured to enter the first heat exchange chamber, the third wall part extends downwards to a third height level, the fourth wall part extends upwards to a fourth height level, and the third height level is at a lower vertical level than the fourth height level.

17. Use of the circulating fluidized bed boiler of claim 1, comprising letting out fluidizing gas and bed material from the first heat exchange chamber via the primary particle outlet.

18. The use of claim 17, comprising:

letting out fluidizing gas and bed material from the first heat exchange chamber) via the primary particle outlet such that a flow velocity of the fluidizing gas at the primary particle outlet is at most 20 m/s and directed out of the first heat exchange chamber, wherein preferably the flow velocity of the fluidizing gas at the primary particle outlet is from 5 m/s to 10 m/s and directed out of the first heat exchange chamber.

* * * * *